United States Patent [19]

Allen

[11] Patent Number: 4,728,134

[45] Date of Patent: Mar. 1, 1988

[54] GOLF BALL RETRIEVER

[76] Inventor: Frank R. Allen, 51 Renfield Crescent, Whitby, Ontario, Canada, L1P 1B2

[21] Appl. No.: 61,719

[22] Filed: Jun. 15, 1987

[51] Int. Cl.[4] ..... A63B 47/02; A47F 13/06

[52] U.S. Cl. ..... 294/19.2; 273/32 F; 273/162 E

[58] Field of Search ..... 294/19.2, 19.1; 273/32 F, 32 D, 32 B, 162 E, 162 R, 162 F

[56] References Cited

U.S. PATENT DOCUMENTS 2,204,482 6/1940 Filipiak ..... 294/19.2

4,493,503 1/1985 Jeninga ..... 294/19.2

4,687,204 8/1987 Lempio ..... 273/162 E

*Primary Examiner*—James B. Marbert

[57] ABSTRACT

A device for retrieving a golf ball comprising an elongate handle and an inverted cup pivotally mounted on the end of the handle. The cup comprises a U-shaped member having a pair of laterally resilient side members carrying a pair of inwardly directed bails which cross to form an opening. The bails are laterally resilient which allows the opening to be expanded by the upward pressure when the cup is moved downwardly over the golf ball, allowing the ball to be entrapped. The ball is released by squeezing the side members towards each other.

8 Claims, 4 Drawing Figures

GOLF BALL RETRIEVER

FIELD OF THE INVENTION

This invention relates to a device for picking up golf balls.

BACKGROUND OF THE INVENTION

Devices are presently known which will retrieve golf balls from inaccessible places such as water traps. In such devices a retrieval means, mounted on the end of an elongate handle, is pushed against the ball which faces the ball past laterally movable bail or spring members into a pocket. One such device is shown in U.S. Pat. No. 4,493,503 issued Jan. 15, 1985 to J. Jeniga in which bail members, pivotably mounted freely on a frame, move laterally apart under pressure to pass a golf ball into a pocket formed by the frames. In another device shown in U.S. Pat. No. 4,334,707 issued June 15, 1982 to C. S. Phillips fixed resilient springs forming a pocket move laterally apart under pressure to pass a golf ball into the pocket. In the Jeninga device the ball is removed by lifting he bails to allow the ball to drop from the pocket. In the Phillips device the ball is removed from the pocket by pulling the ball against the springs. In each of these devices the method of removing the ball from the device is awkward. Also in the Jeninga device the retrieval means is fixed to the handle which means that in the Jeninga device the ball must be resting on a substantially horizontal surface for an operator to cover it while in the Phillips device the ball would be difficult to grasp if resting on a substantially horizontal surface because it would be pushed away instead of being forced between the springs and since the retrieval means is fixed to the handle the ball might be inaccessible if lying in a depression.

It is an object of the present invention to provide a device for retrieving a golf ball in which a ball entrapped by the device may be released simply by applying lateral manual pressure.

It is a further object of the invention to provide such a device which is operable to retrieve a golf ball which is lying on a horizontal or non-horizontal surface and under difficult hazard trap conditions such as silt or mud.

SUMMARY OF THE INVENTION

Essentially the invention consists of a device for retrieving golf balls comprising an elongate handle and an inverted cup pivotally mounted on the end of the handle. The cup comprises a U-shaped member having a pair of laterally resilient side members carrying a pair of inwardly directed bails which cross to form an opening. The bails are laterally resilient which allows the opening to be expanded by the upward pressure when the cup is moved downwardly over the golf ball, allowing the ball to be entrapped. The ball is released by squeezing the side members towards each other.

BRIEF DESCRIPTION OF DRAWINGS

An example embodiment of the invention is shown in the accompanying drawings in which.

DESCRIPTION OF PREFERRED EMBODIMENT

Figure 1:
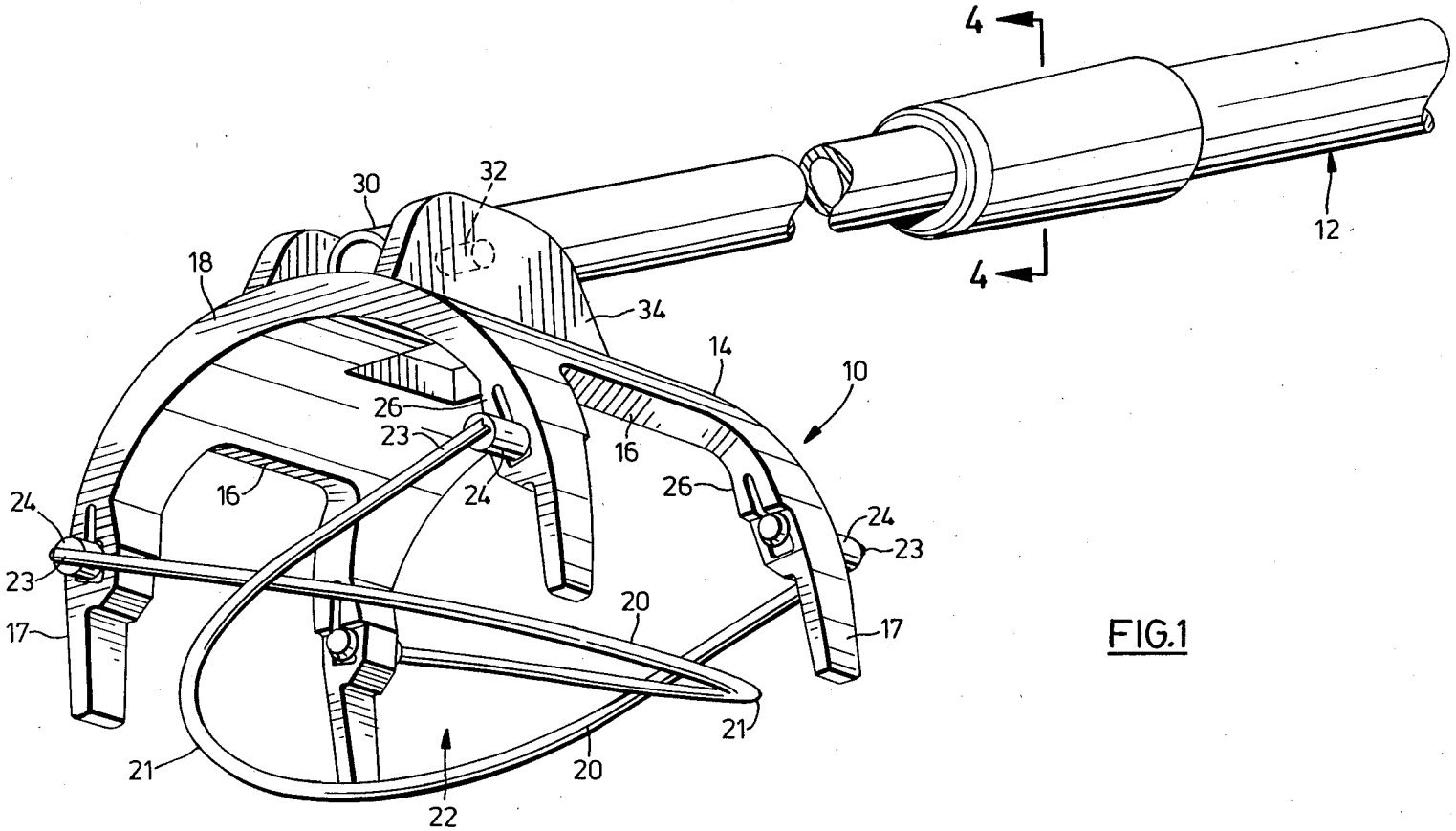
FIG. 1 is perspective view of golf ball retriever.

The example embodiment shown in the drawings consists of a cup 10 mounted on the end of a handle 12.

Cup 10 comprises an inverted U-shaped frame 14 having a pair of opposed forked side members 16 and a base 18. Each side member 16 is bifurcated to form a pair of downwardly extending legs 17 and carries a fixed bail 20 which extends inwardly and has a crown 21 located adjacent the opposite side member. Bails 20 slope downwardly towards the opposite side member 16 and cross one another in the vicinity of their midpoints, one bail passing within the other bail, to form an opening 22 with the distance between crowns 21 being slightly less than the diameter of a golf ball. Ends 23 of each bail 20 lie laterally of the associated side member 16 and carry inwardly projecting bosses 24 which are keyed into slots 26 in the forks of the side member and snaplock into the slots.

Figure 4:
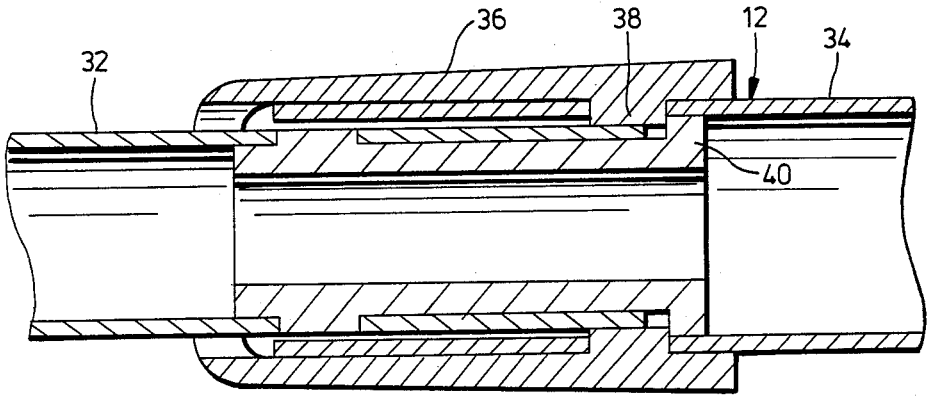
FIG. 4 is a cross-sectional view of the handle of the device taken along line 4—4 of FIG. 1.

Handle 12 is pivotally connected at its end 30 by a pair of bosses 32 to a pair of spaced flanges 34 fixed to base 18 of frame 14 of cup 10, cup 10 being snaplocked to the handle. As seen in FIG. 4 of the drawings, handle 12 is telescopic and consists of a first tubular member 32 slidable in a second tubular member 34. A sleeve 36 is fixed to the end of member 34 and carries an inwardly projecting shoulder 38. A flange 40 on the end of member 32 abuts shoulder 38 to prevent the two tubular members from separating. Flange 40 is frictionally slidable along the interior surface of member 34.

Frame 14 is made of material which is slightly resilient such as the plastic Laxan (a trade mark) and bails 20 are made of spring material.

Figure 2:
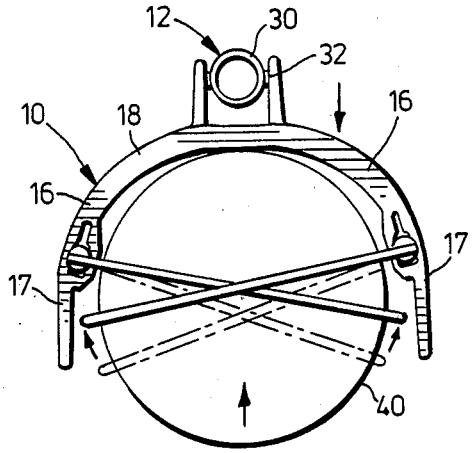
FIG. 2 is an end view of the device of FIG. 1 showing a golf ball being received by the device.
Figure 3:
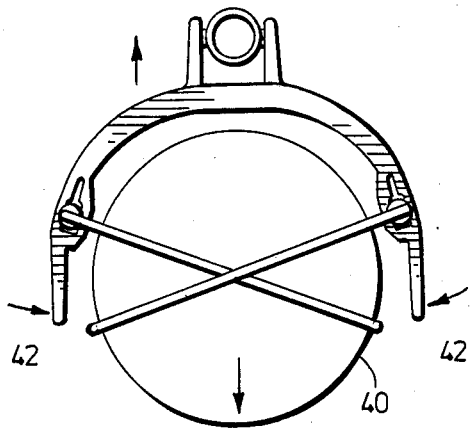
FIG. 3 is a view similar to FIG. 2 showing a golf ball being removed from the device.

The operation of the device is seen in FIGS. 2 and 3 of the drawings. A person manipulating handle 12 places cup 10 over a golf ball 40 to be retrieved. End 30 of handle 12 is then lowered, causing ball 40 to press against bails 20 which forces the bails upwardly and allows the ball to pass between the bails into cup 10, as seen in FIG. 2, whereupon the bails spring back into a position of rest as seen in FIG. 3, trapping the ball in the cup. To release ball 40 from cup 10 it is merely necessary to press sides 16 or legs 17 of frame 14 towards one another, as indicated by arrows 42 in FIG. 3, which spreads bails 10 and allows the ball to pass between them and out of the cup.

Handle 12 is telescopic, allowing the length of the device to be adjusted. Also cup 10 is pivotally mounted on handle 12 which allows the cup to be self-adjusting when lowered over ball 40 which may lie on a non-horizontal surface.

Legs 17 of frame 14 are of a length to contact the ground adjacent ball 40 and prevent excess compression on the ball while acting as buffers against lateral pressure. The spring of bails 20 allows them to be snaplocked onto frame 14. Also pin 32 on flanges 34 of frame 14 may be replaced by a pair of opposed bosses on the flanges which snaplock into apertures in end 30 of handle 12. If desired, sides 16 of frame 14 can be made thinner to provide additional inward lateral flexibility as ball 40 passes between bails 20.

I claim:

1. A device for retrieving a golf ball comprising: an elongate handle; and a cup carried at one end of the handle to receive the golf ball and comprising an inverted U-shaped frame with a base and a pair of opposed resilient side members, the base being pivotally mounted on the handle, a pair of bails one mounted on each of the side members of the frame, the bails each extending downwardly towards the opposing side member and crossing one with the other to form an opening having the distance between the crowns of the bails slightly less than the diameter of a golf ball, the bails being laterally resilient to enlarge the opening and pass the ball on pressure of the ball against the bails and to spring back to entrap the ball in the cup, the side members being laterally resilient to release the ball from the cup when pressed laterally to enlarge the opening.

2. A device as claimed in claim 1 in which the handle is telescopic.

3. A device as claimed in claim 1 in which bails are snaplocked in the side members.

4. A device as claimed in claim 1 in which each said member is bifurcated to form a pair of downwardly extending legs.

5. A device as claimed in claim 4 in which the bails are snaplocked in the legs.

6. A device as claimed in claim 1 in which the cup is pivotally mounted on the end of the handle.

7. A device as claimed in claim 6 in which the cup is snaplocked on the end of the handle.

8. A device as claimed in claim 1 in which the resiliency of the side members assists in enlarging the opening to entrap the ball.

* * * * *